US006238832B1

(12) United States Patent
Hashizume et al.

(10) Patent No.: US 6,238,832 B1
(45) **Date of Patent: *May 29, 2001**

(54) ELECTROPHOTOGRAPHIC PHOTOSENSITIVE MEMBER

(75) Inventors: Junichiro Hashizume; Shigenori Ueda, both of Nara; Makoto Aoki, Joyo, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/220,072

(22) Filed: Dec. 23, 1998

(30) Foreign Application Priority Data

Dec. 25, 1997 (JP) ..... 9-358265

(51) Int. Cl.[7] ..... G03G 15/04
(52) U.S. Cl. ..... 430/67; 430/84
(58) Field of Search ..... 430/67, 84

(56) References Cited

U.S. PATENT DOCUMENTS

| | | | | |
|---|---|---|---|---|
| 4,770,966 | | 9/1988 | Kazama et al. | 430/66 |
| 5,139,911 | | 8/1992 | Yagi et al. | 430/66 |
| 5,242,776 | * | 9/1993 | Doi et al. | 430/67 |
| 5,273,851 | * | 12/1993 | Takei et al. | 430/66 |
| 5,308,727 | * | 5/1994 | Osawa et al. | 430/58 |
| 5,392,098 | | 2/1995 | Ebara et al. | 355/219 |
| 5,624,776 | * | 4/1997 | Takei et al. | 430/56 |
| 5,670,286 | | 9/1997 | Takei et al. | 430/66 |
| 5,849,446 | | 12/1998 | Hashizume et al. | 430/67 |
| 5,976,745 | | 11/1999 | Aokio et al. | 430/66 |

FOREIGN PATENT DOCUMENTS

| | | |
|---|---|---|
| 3821665 | 1/1989 | (DE) . |
| 0262570 | 4/1988 | (EP) . |
| 0785475 | 7/1997 | (EP) . |
| 115551 | 7/1982 | (JP) . |
| 186849 | 9/1985 | (JP) . |
| 219961 | 9/1986 | (JP) . |
| 317920 | 11/1994 | (JP) . |

* cited by examiner

*Primary Examiner*—Mark Chapman
(74) *Attorney, Agent, or Firm*—Fitzpatrick, Cella, Harper & Scinto

(57) ABSTRACT

For achieving satisfactory electrical characteristics and high image quality without peeling, damage or abrasion in a long use term the present invention provides an electrophotographic photosensitive member which comprises, on a conductive substrate, a photoconductive layer composed of a non-single-crystalline material containing silicon atoms as a matrix, and a surface layer composed of non-single-crystalline carbon containing at least hydrogen, wherein the surface layer has a surface roughness Rz within a range from 500 Å to 2000 Å for a reference length of 5 $\mu$m and contains at least oxygen, nitrogen, fluorine and boron atoms.

5 Claims, 4 Drawing Sheets

ELECTROPHOTOGRAPHIC PHOTOSENSITIVE MEMBER

BACKGROUND OF THE INVENTION

1. Field of the Invention

The present invention relates to an electrophotographic photosensitive member, and more particularly to an electrophotographic photosensitive member without generation of damage and abrasion, and excellent copying durability, a long use life, a small variation in potential characteristics, a high sensitivity and a little generation of residual image phenomenon.

2. Related Background Art

For use in the electrophotographic photosensitive member, there have been proposed various materials such as selenium, cadmium sulfide, zinc oxide, phthalocyanine, amorphous silicon (hereinafter, referred to as "a-Si"). Among these, the non-single-crystalline deposited film containing silicon atoms as a main component which is represented by a-Si, for example, amorphous deposited film such as a-Si film compensated with hydrogen atoms and/or halogen (fluorine, chlorine, or the like) atoms has been proposed as a non-polluting photosensitive member of high performance and high durability, and has already been practically used. Such deposited film can be formed by various known methods, such as sputtering, thermal CVD in which raw material gas is decomposed by heat, photo CVD in which raw material gas is decomposed by light, and plasma CVD in which raw material gas is decomposed by plasma. In particular, the plasma CVD method, in which the raw material gas is decomposed by glow discharge of a DC, high frequency (RF, VHF), microwave or the like to form a thin deposited film on a conductive substrate such as of glass, quartz, heat-resistant plastic film, stainless steel or aluminum, has been significantly developed in the formation of the electrophotographic a-Si deposited film and various apparatus have been proposed therefor.

For example, the Japanese Patent Application Laid-Open No. 57-115551 discloses a photoconductive member including a photoconductive layer of an amorphous material mainly composed of silicon atoms and containing at least either of hydrogen atoms and halogen atoms, and a surface barrier layer formed thereon of an amorphous material composed of silicon and carbon atoms as a matrix and containing hydrogen atoms. Also, the Japanese Patent Application Laid-Open No. 61-219961 discloses an electrophotographic photosensitive member composed of an a-Si based photosensitive layer and a surface protective layer formed thereon of amorphous carbon film (hereinafter, referred to as "a-C:H") containing hydrogen atoms in 10 atomic % to 40 atomic %. The Japanese Patent Application Laid-Open No. 6-317920 discloses a method of utilizing a high frequency of 20 MHz or more and forming an electrophotographic photosensitive member composed of a photoconductive layer of a non-single-crystalline silicon material containing silicon atoms as a matrix and an a-C:H surface protective layer having a hydrogen atom content of 8 atomic % to 45 atomic %. The Japanese Patent Application Laid-Open No. 60-186849 discloses a method and an apparatus for forming an electrophotographic device with a top inhibition layer, by microwave plasma CVD utilizing a microwave (for example, 2.45 GHz) for decomposing a raw material gas.

By utilizing these technologies, the electrophotographic photosensitive member has been improved in the electrical, optical, photoconductive and use ambient characteristics and in durability, and also the improvement in the image quality has been made possible.

In recent years, however, higher image quality and higher speed are required for the electrophotographic apparatus. A higher speed in the electrophotographic apparatus can be achieved by shortening the steps of charging, exposure, development, image transfer and charge elimination. Consequently it is necessary to increase the advancing speed of the copying sheet. In such case, the contact number per unit time and the contact time of the electrophotographic photosensitive member with the copying sheet or with the cleaning mechanism increase drastically. Also the complete cleaning becomes more difficult as the process speed becomes higher. For this reason, the contact force of the cleaning blade to the electrophotographic photosensitive member is generally increased in order to prevent defective cleaning resulting from the vibration of the cleaning blade or the toner escaping under the blade. Therefore, with an increase in the process speed, the photosensitive drum is subjected to a larger frictional force, resulting in physical damages such as frictional damages, or even abrasion of the surface layer which has been entirely intact in the conventional process.

For this reason, there has been desired an electrophotographic photosensitive member that is free from abrasion of the photosensitive member in any high-speed process. Such abrasion becomes more conspicuous when the electrophotographic photosensitive member is made smaller for compactizing the electrophotographic apparatus. For avoiding such damage or abrasion, the outermost surface of the electrophotographic photosensitive member is made harder or more slippery.

As a material meeting such object, a hydrogen-containing amorphous carbon film (hereinafter, referred to as "a-C:H film") is attracting attention. It is considered that a-C:H film, known also as diamond-like carbon (DLC), is an optimum material for the above-described object, because of very high hardness and a specific lubricating property. However, though the a-C:H film has a very high hardness, it shows a high stress in the film and tends to be easily peeled off. For this reason, there has been desired a technology capable of depositing a film of necessary thickness without peeling. Also, the film quality of a semiconductor film needs improvement, in consideration of use in the electrophotographic photosensitive member. More specifically, when the a-C:H film is employed in the surface of the electrophotographic photosensitive member, it often causes adverse effects such as a lowered sensitivity, an increased residual image phenomenon and an increased residual potential.

On the other hand, with increase in the process speed for increasing the speed of the apparatus, the charging ability is lowered because of a shorter charging time. With such decrease of the charging ability, a desired charged potential cannot be obtained unless charged charges are correspondingly increased, and the amount of the photocarriers required for dissipating such increased charges increases inevitably. Therefore, the charging ability and the sensitivity are generally lowered as the process speed becomes higher. For this reason, the improvements in the charging ability and in the sensitivity are more strongly required.

Furthermore, a higher image quality is strongly required for a high-speed electrophotographic apparatus in recent years in addition to a productivity, though the productivity rather than the image quality has been so strongly required for the conventional high-speed electrophotographic apparatus. The electrophotographic photosensitive member using a-Si tends to show the residual image phenomenon in which a previously copied image is thinly copied in a portion of an intermediate density of a next copied image, and the improvement of such residual image phenomenon is strictly required for the higher image quality in recent years.

SUMMARY OF THE INVENTION

Objects of the present invention are:

(1) to provide an electrophotographic photosensitive member of satisfactory durability, not generating damage or abrasion in a long use term for the recent electrophotographic apparatus of high speed and long use life which has any configuration of the apparatus body;

(2) to provide a surface layer free from drawbacks such as film peeling under any condition;

(3) to provide an electrophotographic photosensitive member optimum for use in an electrophotographic apparatus, capable of providing a sufficient charging ability, a high sensitivity and a sufficiently low residual potential even in a high-speed electrophotographic process; and (4) to provide an electrophotographic photosensitive member capable of satisfactorily meeting the recent requirement for higher image quality in the electrophotographic apparatus, namely capable of stably providing a halftone image of uniform density with a little residual image phenomenon and providing a sharp image of high resolution over a long use term.

It is also an object of the present invention to provide an electrophotographic photosensitive member comprising: on a conductive substrate, a photoconductive layer composed of a non-single-crystalline material containing silicon atoms as a matrix, and a surface layer composed of non-single-crystalline carbon containing at least hydrogen, wherein the surface layer has a surface roughness Rz of a range from 500 Å to 2000 Å for a reference length of 5 $\mu$m and contains at least oxygen, nitrogen, fluorine and boron atoms.

In the surface layer of the above-mentioned photosensitive member, the content of the oxygen, nitrogen, fluorine and boron atoms may be larger than that in a layer adjacent to the surface layer, and a buffer layer may be provided between the photoconductive layer and the surface layer.

The buffer layer may be composed of a non-single-crystalline material containing silicon atoms as a matrix and further carbon atoms, and may simultaneously contain all the oxygen, nitrogen, fluorine and boron atoms, and the content of each of such atoms may be made larger than that in the photoconductive layer adjacent to the buffer layer.

Furthermore, each of the content of the oxygen, nitrogen, fluorine and boron atoms in the surface layer is desirably within a range from 0.001 atomic % to 5 atomic %.

For attaining the above-mentioned objects, the present inventors have tried to employ a non-single-crystalline carbon film (hereinafter, referred to as "a-C:H film") as the surface protective layer. As explained in the foregoing, the a-C:H film has a very high hardness, as known by the name of DLC (diamond-like carbon), and the use of a surface protective layer consisting of a-C:H film in the conventional electrophotographic photosensitive member has been found to show a significant effect of preventing scraping or damage on the photosensitive member. However, since such a-C:H film having a strong resistance to scrape shows a high internal stress and is very easily peeled, it has not been easy to reproducibly deposit such film with a desired film thickness, and to effectively use such film as the surface layer of the electrophotographic photosensitive member.

Further study on the ease of peeling has revealed that it is correlated with the surface roughness of the a-C:H layer. More specifically, satisfactory adhesion is obtained when the surface roughness Rz of the surface layer is 500 Å or more for a reference length of 5 $\mu$m. A larger surface roughness of the a-C:H surface layer means a rougher interface between the surface layer and the photoconductive layer, and the improved adhesion is presumably obtained by an increased contact area. On the other hand, a surface roughness Rz exceeding 2000 Å has been found to result in a loss in the sensitivity. The cause for this phenomenon is not clarified at present, but is presumed to be related with light scattering caused by surface roughness. The resistance against peeling has been found to be sufficiently high when the surface roughness Rz of the a-C:H layer itself is in a range from 500 Å to 2000 Å, and it has not been necessary to directly define the surface roughness of the photoconductive layer.

One specific feature of the present invention is further to simultaneously contain N, O, F and B atoms in the a-C:H layer at contents higher than those in a layer adjacent to the a-C:H layer. The simultaneous presence of all these atoms have been found to further improve the adhesion of the surface layer. The peeling of unknown cause, occasionally encountered even when the surface roughness is controlled within the above-described range, can be reduced to a substantially zero level by the presence of these atoms.

The effect of the contents of N, O, F and B atoms in the surface layer is revealed to be effective not only in improving the adhesion but also in improving the charging ability and photosensitivity of the electrophotographic photosensitive member, and in reducing the residual image phenomenon. It is presumed that N, O, F and B atoms remove structural defects in the a-C:H film by relaxing the structure thereof and also effectively function as terminators. The semiconductive characteristics of the a-C:H film are still in the course of development and still have rooms for improvement, but the N, O, F and B atoms are presumed to have specific affinity to the a-C:H film and to effectively decrease the density of local energy levels generated by the structural defects present in the film. These atoms therefore prevent injection of charge carriers through the structural defects present in the surface layer, thereby improving the charging ability. They also prevent trapping of the photocarriers in the local energy levels, thereby improving the photosensitivity and reducing the residual image phenomenon.

The content of each of N, O, F and B atoms is desirably within a range from 0.001 atomic % to 5 atomic %. The atomic % means the ratio of the number of interesting atoms to the total number of all atoms.

The above-mentioned effects cannot be obtained when each content is less than 0.001 atomic %. On the other hand, when each content exceeds 5 atomic %, the a-C:H films shows a reduced band gap, leading to a deterioration in the photosensitivity.

The above-described effects can be obtained when the N, O, F and B atoms are simultaneously contained. The combination of these elements is important since the improvement in the charging ability, sensitivity and residual image phenomenon cannot be obtained in the case any one of these elements is absent.

DESCRIPTION OF THE PREFERRED EMBODIMENTS

Figure 1:
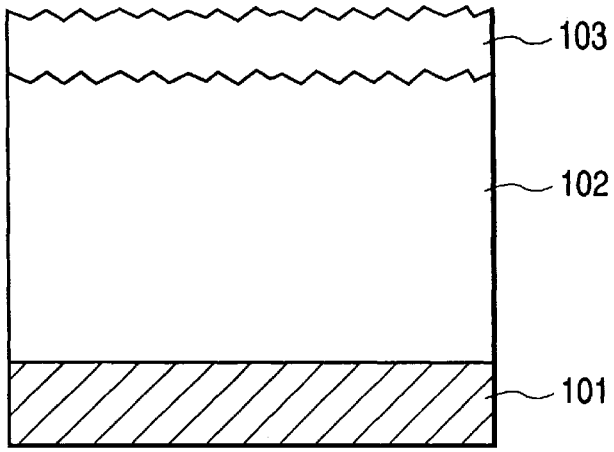
FIGS. 1, 2, 3, 4 and 5 are schematic cross-sectional views showing preferred embodiments of the electrophotographic photosensitive member of the present invention.

In the following the present invention will be described in more details with reference to the attached drawings. FIGS. 1 to 5 are schematic cross-sectional views showing embodiments of the electrophotographic photosensitive member of the present invention. FIG. 1 shows a photosensitive member of so-called single layer type in which the photoconductive layer is not functionally separated, and which has an a-Si photoconductive layer 102 containing at least hydrogen, and a surface layer 103 consisting of non-single-crystalline carbon are deposited in this order on a conductive substrate 101. The surface layer 103 contains N, O, F and B atoms in contents larger than those in the photoconductive layer 102 and has a surface roughness Rz for a reference length of 5 μm which is controlled within a range from 500 Å to 2000 Å.

Figure 2:
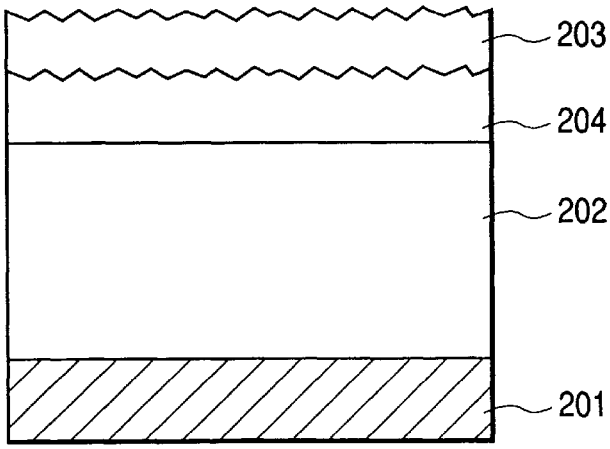

FIG. 2 is a schematic view showing the case of providing a buffer layer 204 between the surface layer 203 and the photoconductive layer 202 of the electrophotographic photosensitive member shown in FIG. 1. The surface layer 203 contains N, O, F and B atoms in contents larger than at least those in the buffer layer 204, and has a surface roughness Rz for a reference length of 5 μm which is controlled within a range from 500 Å to 2000 Å. In this case, the contents of the N, O, F and B atoms in the buffer layer 204 may be made larger than those in the photoconductive layer 202.

Figure 3:
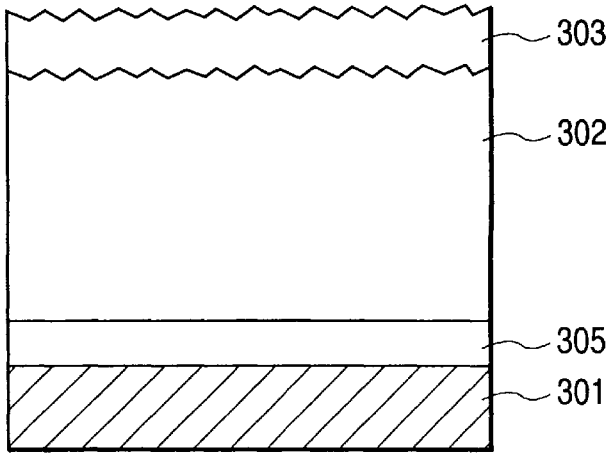

FIG. 3 is a schematic view showing the case of providing a lower inhibition layer 305 between the photoconductive layer 302 and the conductive substrate 301 in the electrophotographic photosensitive member of the present invention shown in FIG. 1.

Figure 4:
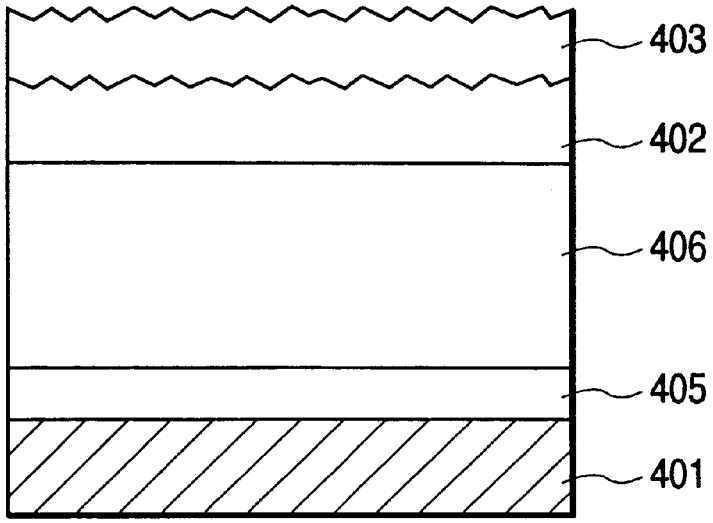

FIG. 4 shows a photosensitive member of so-called functionally separated type, in which the photoconductive layer is functionally separated into a charge generation layer and a charge transportation layer. On a conductive substrate 401, there is formed, if necessary, a lower inhibition layer 401. There are deposited thereon a-Si layers containing at least hydrogen and constituting a charge transportation layer 406 and a charge generation layer 402 which are separated in function, and a surface layer 403 consisting of non-single-crystalline carbon is further deposited thereon. The charge transportation layer 406 and the charge generation layer 402 need not be necessarily provided in the order illustrated in FIG. 4 but may be provided in an arbitrary order. Also, when the functional separation of the layer is achieved by varying the layer composition, such compositional variation may be made in a continuous manner.

Figure 5:
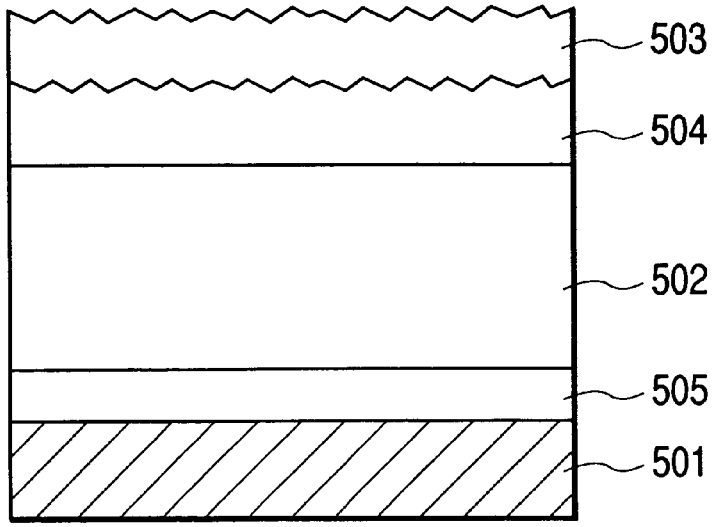

FIG. 5 is a schematic view of a configuration of the electrophotographic photosensitive member consisting of a conductive substrate 501, a lower inhibition layer 505, a photoconductive layer 502, a buffer layer 504 and a surface layer 503.

In the photosensitive members shown in FIGS. 1 to 5, each of the constituent layers may involve a continuous variation in the composition, and a distinct interface need not necessarily be present between these layers.

The conductive substrate 101, 201, 301, 401 or 501 to be employed in the present invention may be composed of a material or may have a shape determined according to the purpose of use. For example, with respect to the shape, a cylindrical substrate is desirable in case of use as the electrophotographic photosensitive member, but a flat plate shape, an endless belt shape or other shapes may be adopted according to the necessity. The thickness of the substrate is suitably determined in order to obtain a desired electrophotographic photosensitive member, but may be made as small as possible within an extent that the function of the substrate can be satisfactorily exhibited, when flexibility is required. However, the thickness of the substrate is usually 10 μm or more, in consideration of the ease of manufacture and handling and of the mechanical strength. The substrate may be composed of copper, aluminum, gold, silver, platinum, lead, nickel, cobalt, iron, chromium, molybdenum, titanium, stainless steel, or a composite material containing at least two of the foregoing materials, or an insulating material such as polyester, polyethylene, polycarbonate, cellulose acetate, polypropylene, polyvinyl chloride, polyvinylidene chloride, polystyrene, glass, ceramics or paper, which are covered with a conductive material.

The lower inhibition layer 305, 405 or 505 in the electrophotographic photosensitive member of the present invention has so-called polarity dependence, showing a function of inhibiting charge injection from the conductive substrate to the photoconductive layer in case the free surface of the electrophotographic photosensitive member is subjected to a charging process of a certain polarity, but not showing such function in case of being subjected to a charging process of opposite polarity. For realizing such function, the lower inhibition layer 305, 405 or 505 contains atoms controlling the conductivity in a relative large amount, in comparison with the photoconductive layer. The conductivity-controlling atoms contained in the lower inhibition layer 305, 405 or 505 can be those of the group IIIb or Vb of the periodic table. The amount of the conductivity-controlling atoms contained in the lower inhibition layer 305, 405 or 505 can be suitably determined for effectively attaining the objects of the present invention, but is preferably within a range of 10 to $1\times10^4$ atomic ppm, more preferably 50 to $5\times10^3$ atomic ppm, and more preferably $1\times10^2$ to $1\times10^3$ atomic ppm.

The lower inhibition layer 305, 405 or 505 may further contain at least one of carbon, nitrogen and oxygen atoms in order to further improve the adhesion to another layer which is in direct contact with the lower inhibition layer. The content of the carbon atoms and/or the nitrogen atoms and/or the oxygen atoms contained in the entire lower inhibition layer is, as the content of a single element when used the single element or as the summed content when used two or more elements, preferably within a range of $1\times10^{-3}$ to 50 atomic %, more preferably $5\times10^{-3}$ to 30 atomic % and most preferably $1\times10^{-2}$ to 10 atomic %.

Hydrogen atoms and/or halogen atoms to be contained in the lower inhibition layer compensate dangling bonds present in the layer, thus effective in improving the film quality. The total amount of the hydrogen and/or halogen atoms present in the lower inhibition layer is preferably within a range of 1 atomic % to 50 atomic %, more preferably 5 atomic % to 40 atomic % and most preferably 10 atomic % to 30 atomic %.

The thickness of the lower inhibition layer is preferably within a range of 0.1 to 5 μm, and most preferably 1 to 4 μm, in order to obtain desired electrophotographic characteristics, and a high sensitivity in economical manner.

The photoconductive layer 102, 202, 302, 402 or 502 in the electrophotographic photosensitive member of the present invention indispensably contains hydrogen and/or halogen atoms therein, in order to compensate the dangling bonds of silicon atoms, to improve the layer quality and particularly to improve the photoconductivity and the charge retaining characteristics. The content of hydrogen atoms or halogen atoms or the summed content of hydrogen atoms and halogen atoms is preferably within a range of 10 atomic % to 30 atomic % and more preferably 15 atomic % to 25 atomic %, with respect to the sum of silicon atoms and hydrogen atoms and/or halogen atoms. The amount of hydrogen atoms and/or halogen atoms contained in the photoconductive layer can be controlled, in the layer formation, for example by the temperature of a substrate, the amount introduced into a reactor of a raw material employed for introducing hydrogen atoms and/or halogen atoms, an electric discharge power and so on.

If necessary, the photoconductive layer 102, 202, 302, 402 or 502 preferably contain atoms for controlling the conductivity. Such conductivity-controlling atoms can be similar to those employed in the lower inhibition layer. The content of the conductivity-controlling atoms in the photoconductive layer is preferably within a range of $1\times10^{-2}$ to $1\times10^{4}$ atomic ppm, more preferably $5\times10^{-2}$ to $5\times10^{3}$ atomic ppm, and most preferably $1\times10^{-1}$ to $1\times10^{3}$ atomic ppm.

It is also effective to include carbon atoms and/or oxygen atoms and/or nitrogen atoms in the photoconductive layer. The content of these atoms is preferably within a range of $1\times10^{-5}$ to 10 atomic %, more preferably $1\times10^{-4}$ to 8 atomic % and most preferably $1\times10^{-3}$ to 5 atomic % with respect to the sum of silicon, carbon, oxygen and nitrogen atoms. The carbon atoms and/or oxygen atoms and/or nitrogen atoms need not necessarily be contained over the entire layer but may be contained only in a part of the layer or may be contained in a distribution having different concentrations in the thickness direction.

The thickness of the photoconductive layer is suitably determined so as to obtain desired electrophotographic characteristics and in consideration of the economical effect, and is preferably in a range of 10 to 50 $\mu$m, more preferably 20 to 45 $\mu$m and most preferably 25 to 40 $\mu$m.

The buffer layer 204 or 504 is provided, if necessary for achieving mechanical and electrical matching, between the photoconductive layer 202, 502 and the surface layer 203, 503. In consideration of the matching between the photoconductive layer 202, 502 and the surface layer 203, 503, the buffer layer is preferably composed of a SiC layer of an intermediate composition. The buffer layer 204 or 504 may be an uniform layer with a constant composition, or may be continuously varied in composition. The buffer layer may contain N, O, F and B atoms, if necessary. In such case, the content thereof can be made larger than that in the photoconductive layer, in order to improve the adhesion.

The buffer layer 204 or 504 may also contain conductivity-controlling atoms similarly to the case of the lower inhibition layer 305 or 505. As the conductivity-controlling atoms contained in the buffer layer, atoms of the group IIIb or Vb of the periodic table can be used. In the present invention, the content of the conductivity-controlling atoms contained in the buffer layer is suitably determined so as to effectively attain the objects of the present invention, but is preferably in a range of 10 to $1\times10^{4}$ atomic %, more preferably 50 to $5\times10^{3}$ atomic % and most preferably $1\times10^{2}$ to $1\times10^{3}$ atomic %.

The thickness of the buffer layer is suitably determined according to the purpose, but is generally within a range of 0.01 $\mu$m to 10 $\mu$m, more preferably 0.05 $\mu$m to 5 $\mu$m and more preferably 0.1 $\mu$m to 1 $\mu$m.

The surface layer 103, 203, 303, 403 or 503 of the present invention is composed of non-single-crystalline carbon. The non-single-crystalline carbon mainly indicates amorphous carbon having intermediate properties between those of graphite and diamond, but may partially contain microcrystals or polycrystals. The surface layer has a free surface and is provided for attaining the objects of the present invention of preventing the damage or abrasion mainly in a long use term and improving the charging ability and sensitivity, without peeling and the increase of residual potential and residual image phenomenon.

The surface layer of the present invention can be prepared by utilizing plasma CVD, sputtering or ion plating, and employing gaseous hydrocarbon at ordinary temperature and atmospheric pressure, but the film prepared by plasma CVD shows high transparency and high hardness and is suitable for use as the surface layer of the electrophotographic photosensitive member. The plasma CVD process for preparing the surface layer may employ any discharge frequency. Industrially, there can be advantageously employed a high frequency of 1 to 450 MHz, called RF band, particularly 13.56 MHz. For forming the surface layer, there is more preferably employed so-called VHF band of 50 to 450 MHz, since the transparency and hardness can be further improved.

The surface layer 103, 203, 303, 403 or 503 of the present invention is required to have a surface roughness Rz within a range from 500 Å to 2000 Å for a reference length of 5 $\mu$m. The surface roughness of the surface layer can be controlled within such range by forming fine irregularities by optimizing the grinding conditions for the conductive substrate. The roughness can also be controlled by regulating various parameters in the preparation of the photoconductive layer 102, 202, 302, 402 or 502. The surface roughness generally becomes larger with an increase in the electric discharge power or in the bias. After the deposition of the photoconductive layer or the buffer layer, the surface roughness can also be adjusted by etching the surface of the layer by generating plasma discharge in fluorine-containing gas or in hydrogen gas.

For attaining the objects of the present invention, it is necessary to further contain all the N, O, F and B atoms in the surface layer. The presence of these atoms is considered to effectively compensate the structural defects in the film by a specific synergistic effect with the a-C:H film, thereby decreasing the density of local energy levels. As a result, the transparency of the film is improved to suppress the undesirable light absorption in the film, thereby drastically improving the photosensitivity. Also the surface layer is made denser, thereby suppressing the injection of charged carriers, thus improving the charging characteristics. At the same time, the N, O, F and B atoms exhibit an effect of improving the film adhesion, whereby a material having a high internal stress such as the a-C:H film can be utilized without film peeling.

The content of each of N, O, F and B atoms is desirably within a range of 0.001 atomic % to 5 atomic %. The above-mentioned effects are reduced when the content of each less than 0.001 atomic %. On the other hand, a content exceeding 5 atomic % reduces the band gap of a-C:H film, thereby leading to deterioration of the photosensitivity.

The a-C:H film employed as the surface layer in the present invention is required to contain a suitable amount of hydrogen atoms. The hydrogen content in the a-C:H film, defined by H/(C+H), is within a range of 10 atomic % to 60 atomic %, preferably 20 atomic % to 40 atomic %. The hydrogen content less than 10 atomic % reduces the optical band gap, thus resulting in an inappropriate sensitivity, while the hydrogen content exceeding 60 atomic % decreases the hardness, thus stimulating the scraping. In general, the optical band gap should advantageously be within a range of 1.2 eV to 2.2 eV, and is preferably 1.6 eV or more in consideration of the sensitivity. The refractive index should advantageously be within a range of about 1.8 to about 2.8. The film thickness is within a range of 50 Å to 10,000 Å, preferably 100 Å to 2,000 Å. The thickness less than 50 Å results in an insufficient mechanical strength while the thickness exceeding 10,000 Å results in an insufficient photosensitivity.

Also according to the present invention, the surface layer may further contain atoms for controlling the conductivity. Such conductivity-controlling atoms can be so-called impurity in the field of a semiconductor, and can be the atoms belonging to the group IIIb of the periodic table for providing p-type conductivity (hereinafter, referred to as "group IIIb atoms") or the atoms belonging to the group Vb of the periodic table for providing n-type conductivity (hereinafter, referred to as "group Vb atoms"). The content of the conductivity-controlling atoms can be suitably determined, but is preferably within a range of 10 to $1\times10^4$ atomic ppm, more preferably 50 to $5\times10^3$ atomic ppm and most preferably $1\times10^2$ to $1\times10^3$ atomic ppm.

The a-C:H surface layer of the present invention may further contain halogen atoms, if necessary.

The substrate temperature at the layer formation is controlled within a range from room temperature to 350° C., but a relatively low temperature is preferred because an excessively high substrate temperature reduce the band gap, thus deteriorating the transparency. The high frequency power is preferably as high as possible in order to achieve sufficient decomposition of hydrocarbon, and, more specifically, it is preferably 5 W/cc or more with respect to the raw material hydrocarbon gas, but should be maintained at a level not causing abnormal discharge, since an excessively high power generates abnormal discharge, thus deteriorating the characteristics of the electrophotographic photosensitive member. The pressure of discharge space is preferably maintained at a relatively high vacuum, since, in case of film formation with a raw material gas such as hydrocarbon which is not likely to easily be decomposed, since the mutual collision of decomposed species in the gas phase tends to lead to polymer formation. The pressure of the discharge space is generally maintained within a range of 13.3 Pa to 1330 Pa in case of usual RF power (representatively 13.56 MHz) or 13.3 mPa to 13.3 Pa in case of VHF band (representatively 50 to 450 MHz).

The conductivity-controlling atoms to be employed in the present invention include as the group IIIb atoms, B (boron), Al (aluminum), Ga (gallium), In (indium) or Ta (thallium), and particularly B, Al and Ga are preferably used. They also include as the group Vb atoms, P (phosphor), As (arsine), Sb (antimony) or Bi (bismuth), and particularly P and As are preferably used.

The group IIIb atoms or the group Vb atoms can be introduced into a layer, at the layer formation, by introducing a raw material for introducing the group IIIb or Vb atoms in a gaseous state into the reaction chamber together with other gasses. It is preferable to use as the raw material for introducing the group IIIb or Vb atoms, a gaseous material at ordinary temperature and atmospheric pressure or a material easily gasifiable at least under the layer forming conditions. Examples of such raw material for introducing the group IIIb atoms include, for introducing boron atoms, boron hydrides such as $B_2H_6$, $B_4H_{10}$, $B_5H_9$, $B_5H_{11}$, $B_6H_{10}$, $B_6H_{12}$ and $B_6H_{14}$, and boron halides such as $BF_3$, $BCl_3$ and $BBr_3$. Examples of the above raw material further include $AlCl_3$, $GaCl_3$, $Gd(CH_3)_3$, $InCl_3$ and $TiCl_3$. Also, examples of the raw material for introducing the group Vb atoms include, for introducing phosphor atoms, phosphor hydrides such as $PH_3$ and $P_2H_4$, and phosphor halides such as $PH_4I$, $PF_3$, $PF_5$, $PCl_3$, $PCl_5$, $PBr_3$, $PBr_5$ or $PI_3$. Examples of the raw material for introducing the group Vb atoms further include $AsH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$ and $BiBr_3$. These raw materials for introducing the conductivity-controlling atoms may be suitably diluted with $H_2$ and/or He.

The material for a Si supplying gas to be employed in the present invention is gaseous or gasifiable silicon hydrides (silanes) such as $SiH_4$, $Si_2H_6$, $Si_3H_8$ and $Si_4H_{10}$. $SiH_4$ and $Si_2H_6$ are preferred in consideration of easy handling at the layer formation and of a high Si supply efficiency.

In order to structurally introduce hydrogen atoms into the layers to be formed, also to facilitate the control on the proportion of introduction of the hydrogen atoms and to obtain the film characteristics meeting the objects of the present invention, the layer formation may be executed by mixing the aforementioned gasses with a desired amount of $H_2$ and/or He as well as hydrogen-containing silicon compound gas. Also, each gas need not be of a single kind but may be a mixture of plural species of a predetermined mixing ratio.

The flow rate of $H_2$ and/or He used as the diluting gas may be suitably selected according to the designing of layers, but, with respect to the Si supplying gas, $H_2$ and/or He is generally controlled within a range of 3 to 20 times of the ordinary case, preferably 4 to 15 times and most preferably 5 to 10 times.

Preferred examples of the halogen atom supplying raw material to be employed in the present invention include gaseous or gasifiable halogen compounds such as halogen gasses, halides, interhalogen compounds and halogen-substituted silane derivatives. Also, there can be effectively utilized gaseous or gasifiable halogen-containing silicon hydrides composed of silicon atoms and halogen atoms. Preferred examples of the halogen compound to be employed in the present invention include fluorine gas ($F_2$), $CF_4$, $C_2F_6$, $C_3F_8$, $C_4F_{10}$, and interhalogen compounds such as BrF, ClF, $ClF_3$, $BrF_3$, $BrF_5$, $IF_3$ and $IF_7$. Preferred examples of halogen-containing silicon compounds or halogen-substituted silane derivatives include silicon fluorides such as $SiF_4$ and $Si_2F_6$.

The material for a carbon supplying gas can be gaseous or gasifiable hydrocarbons such as $CH_4$, $C_2H_6$, $C_3H_8$ or $C_4H_{10}$. $CH_4$ and $C_2H_6$ are preferably used in consideration of easy hanglind at the layer formation and of a high Si supply efficiency.

The material for a nitrogen or oxygen supplying gas can be gaseous or gasifiable compounds such as $NH_3$, NO, $N_2O$, $NO_2$, $O_2$, COL, $CO_2$ and $N_2$.

The atoms contained in each layer may be uniformly distributed over such layer, or may be contained in the entire thickness direction or may be unevenly distributed. In either case, however, it is necessary to uniformly contain the atoms in a plane along a direction parallel to the surface of the substrate, in order to obtain uniform characteristics in the plane.

The gas pressure in the reaction chamber is suitably selected according to the designing of the layers, but is usually maintained within a range of 13.3 mPa to 133 Pa, preferably 66.5 mPa to 665 Pa and most preferably 133 mPa to 133 Pa.

The electric discharge power is also suitably selected according to the designing of layers, but the discharge power with respect to the flow rate of the Si supplying gas is generally selected within a range of 2 to 7 times as large as in the usual case, preferably 2.5 to 6 times and most preferably 3 to 5 times.

The substrate temperature is also suitably selected according to the designing of layers, but is preferably selected within a range of 50° C. to 500° C., more preferably 200° C. to 350° C.

In the present invention, the mixing ratio of the raw material gasses, gas pressure, substrate temperature and electric discharge power for forming the various layers are desirably set within the numerical ranges cited above, but these conditions are generally not determined independently but are desirably determined in mutual relationship for forming the deposited films of the desired characteristics.

In the following, there will be explained an apparatus for forming the deposited films by high frequency plasma CVD and a method for forming such films.

Figure 6:
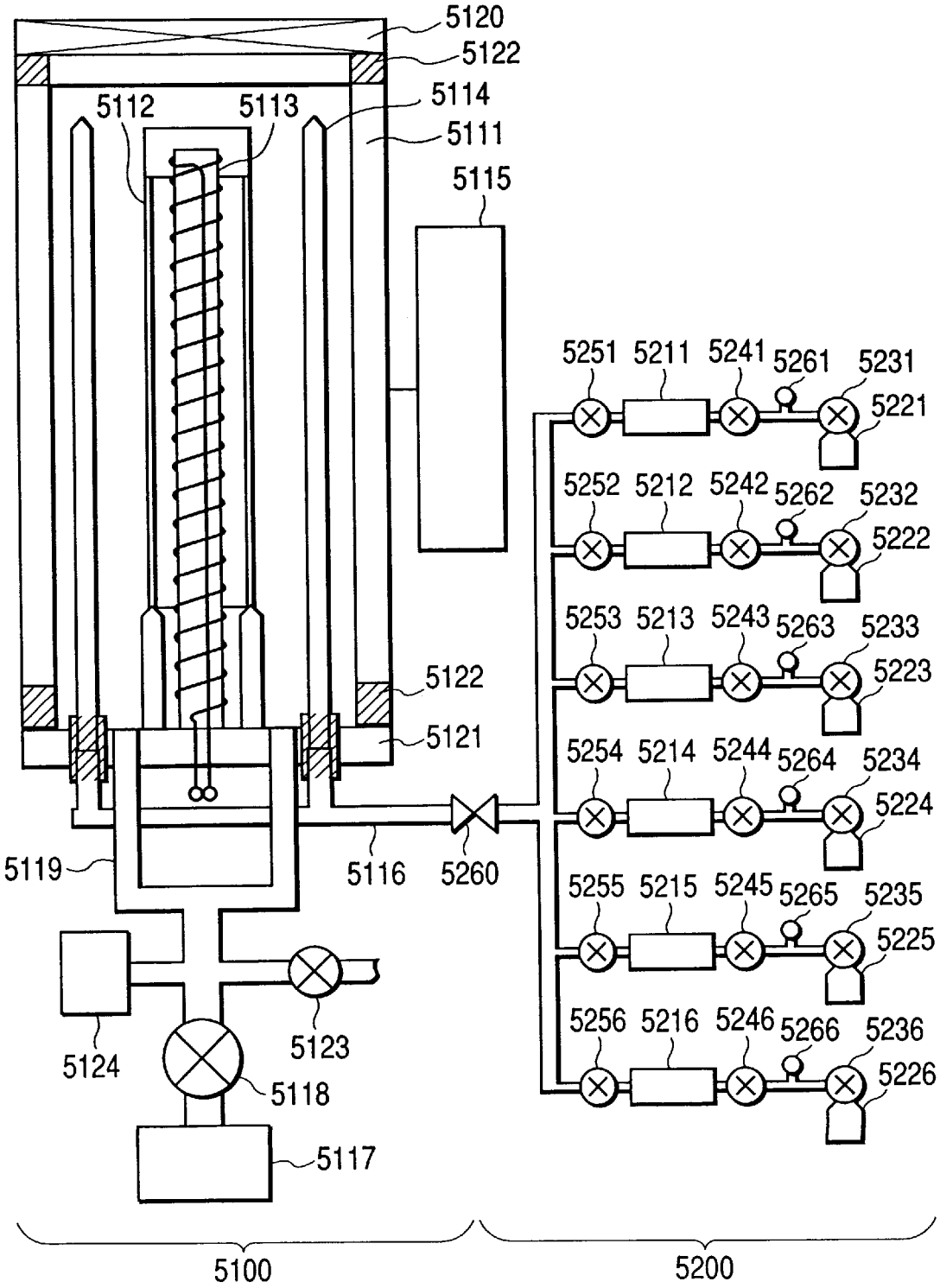
FIGS. 6 and 7 are schematic cross-sectional views showing examples of the apparatus for producing the electrophotographic photosensitive member of the present invention.

FIG. 6 is a schematic view showing an example of the apparatus for producing the electrophotographic photosensitive member by high frequency plasma CVD (hereinafter, referred to as "RF-PCVD"). The apparatus shown in FIG. 6 utilizing RF-PCVD is constructed in the following manner. Basically, the apparatus is composed of a deposition apparatus 5100, a raw material gas supplying apparatus 5200, and an exhaust apparatus 5117 for reducing the internal pressure of a reaction chamber 5111. In the reaction chamber 5111 of the deposition apparatus 5100, there are provided a conductive substrate 5112, a substrate heater 5113 and a raw material gas introduction pipe 5114, and a high frequency matching box 5115 is connected thereto.

The raw material gas supplying apparatus 5200 is composed of containers 5221 to 5226 for the raw materials such as $SiH_4$, $H_2$, $CH_4$, NO, $B_2H_6$ and $GeH_4$, valves 5231 to 5236, 5241 to 5246, 5251 to 5256 and mass flow controllers 5211 to 5216, and each gas container is connected, through a valve 5260, to the gas introduction pipe 5114 in the reaction chamber 5111.

The formation of deposited films by using this apparatus can be executed in the following manner. At first the conductive substrate 5112 is placed in the reaction chamber 5111. The conductive substrate 5112 is preferably cylindrical in case of the electrophotographic photosensitive member. Thereafter, the interior of the reaction chamber 5111 is evacuated by the exhaust apparatus 5117 (for example, a vacuum pump). Then the substrate heater 5113 is turned on to control of the temperature of the conductive substrate 5112 to a predetermined temperature within a range of 250° C. to 500° C.

For introducing the raw material gasses for forming the deposited films into the reaction chamber 5111, there are at first confirmed that the valves 5231 to 5236 of the gas containers and a leak valve 5123 of the reaction chamber are closed and that flow-in valves 5251 to 5256, flow-out valves 5241 to 5246 and an auxiliary valve 5260 are opened. Thereafter, a main valve 5118 is opened, and the interiors of the reaction chamber 5111 and the gas pipes are exhausted. Then, when a vacuum meter 5124 reaches a pressure of about $6.65\times10^{-4}$ Pa, the auxiliary valve 5260 and the flow-out valves 5251 to 5256 are closed.

Subsequently the valves 5231 to 5236 are opened to introduce the gasses from the containers 5221 to 5226, and the pressure of each gas is regulated by the pressure regulators 5261 to 5266 (for example, 200 kPa). Then the flow-in valves 5241 to 5246 are gradually opened to introduce the gasses into the mass flow controllers 5211 to 5216.

When the conductive substrate 5112 reaches a predetermined temperature, necessary valves among the flow-out valves 5251 to 5256 and the auxiliary valve are gradually opened, thereby introducing predetermined gasses from the gas containers 5221 to 5226 into the reaction chamber 5111 through the gas introduction pipe 5114. Then the gasses are regulated to predetermined flow rates by the mass flow controllers 5211 to 5216. At this operation, the aperture of the main valve 5118 is regulated, under the observation of the vacuum meter 5124, in such a manner that the internal pressure of the reaction chamber 5111 reaches a predetermined pressure not exceeding 133 Pa. When the internal pressure is stabilized, an RF power source (not shown in the drawings) is set at a desired power to introduce the RF power into the reaction chamber 5111 through the high frequency matching box 5115, thereby generating RF glow discharge. The discharge energy decomposes the raw material gas introduced into the reaction chamber, whereby the predetermined deposited film is formed on the conductive substrate 5112. After the film formation of a desired thickness, the RF power supply is stopped, and the flow-out valves are closed to stop the gas introduction into the reaction chamber, whereby the formation of a predetermined deposited film is completed. By repeating such operation plural times in a similar manner, there can be obtained the electrophotographic photosensitive member of a multi-layered structure including, for example, a lower inhibition layer, a photoconductive layer and a surface protection layer.

In the formation of each layer, all the flow-out valves are naturally closed except valves for necessary gasses. Also, in order to prevent each gas from remaining in the reaction chamber 5111 or in the pipes from the flow-out valves 5251 to 5256 to the reaction chamber 5111, there is executed, if necessary, an operation of closing the flow-out valves 5251 to 5256, opening the auxiliary valve 5260, fully opening the main valve 5118 and evacuating the interior of the system to a high vacuum. Also for achieving uniform film formation, the conductive substrate 5112 is rotated by a driving apparatus (not shown in the drawings) at a predetermined speed during the film formation. The gas species and the valve operation mentioned above are naturally modified according to the forming conditions of each layer.

In the following, there will be explained a method of producing the electrophotographic photosensitive member by high frequency plasma CVD utilizing VHF frequency band (hereinafter, referred to as "VHF-PCVD"). The apparatus of producing the electrophotographic photosensitive member by VHF-PCVD can be obtained by replacing the RF-PCVD deposition apparatus 5100 shown in FIG. 6 with a deposition apparatus 6100 shown in FIG. 7 and connecting the deposition apparatus 6100 to the raw material gas supplying apparatus 5200.

The above-mentioned apparatus 6100 is composed of a hermetically sealed and evacuatable reaction chamber 6111, a raw material supplying apparatus 5200 and an exhaust apparatus (not shown in the drawings) for reducing the internal pressure of the reaction chamber. In the reaction chamber 6111, there are provided a conductive substrate 6112, a substrate heater 6113, a raw material gas introduction pipe (not shown in the drawings) and an electrode 6115, and a high frequency matching box 6116 is connected thereto. The reaction chamber 6111 is connected to a diffusion pump not shown in the drawings through an exhaust pipe 6121.

The raw material gas supplying apparatus 5200 is composed, as explained in the foregoing, of containers 5221 to 5226 for the raw materials such as $SiH_4$, $GeH_4$, $H_2$, $CH_4$, $B_2H_6$ and $PH_3$, valves 5231 to 5236, 5241 to 5246, 5251 to 5256 and mass flow controllers 5211 to 5216, and the gas containers are connected, through a valve 5260, to the gas introduction pipe (not shown in the drawings) in the reaction chamber 5111. Also, a space surrounded by the conductive substrates 6112 constitutes a discharge space.

The formation of the deposited films in this apparatus by the VHF-PCVD process can be executed in the following manner. At first the conductive substrate 6112 is placed in the reaction chamber 6111, and is rotated by a driving device 6120, and the interior of the reaction chamber 6111 is evacuated by a vacuum apparatus not shown in the drawings (for example, a diffusion pump) to a pressure not exceeding $1.33\times10^{-5}$ Pa. Then the conductive substrate 6112 is heated by the substrate heater 6113 to a predetermined temperature within a range of 50° C. to 500° C.

For introducing the raw material gasses for forming the deposited films into the reaction chamber 6111, there are at first confirmed that the valves 5231 to 5236 of the gas containers and a leak valve not shown in the drawings of the reaction chamber are closed and that flow-in valves 5241 to 5246, flow-out valves 5251 to 5256 and an auxiliary valve 5260 are opened. Thereafter, a main valve (not shown in the drawings) is opened to evacuate the interior of the reaction chamber 6111 and the gas pipes.

Then, when a vacuum meter (not shown in the drawings) shows a pressure of about $6.65\times10^{-4}$ Pa, the auxiliary valve 5260 and the flow-out valves 5251 to 5256 are closed. Subsequently the valves 5231 to 5236 are opened to introduce the gasses from the containers 5221 to 5226, and the pressure of each gas is regulated at $2\times10^5$ Pa by the pressure regulators 5261 to 5266 (for example, at $2\times10^5$ Pa). Then the flow-in valves 5241 to 5246 are gradually opened to introduce the gasses into the mass flow controllers 5211 to 5216.

After the above-described preparations for film formation, deposited films are formed on the conductive substrate 6112 in the following manner.

When the conductive substrate 6112 reaches a predetermined temperature, necessary valves among the flow-out valves 5251 to 5256 and the auxiliary valve 5260 are gradually opened, thereby introducing predetermined gasses from the gas containers 5221 to 5226 into the discharge space 6130 in the reaction chamber 6111 through the gas introduction pipe (not shown in the drawings). Then the gasses are regulated to predetermined flow rates by the mass flow controllers 5211 to 5216. At this operation, the aperture of the main valve (not shown in the drawings) is regulated, under the observation of the vacuum meter, in such a manner that the pressure of the discharge space 6130 reaches a predetermined pressure not exceeding 133 Pa.

When the internal pressure is stabilized, a VHF power source (not shown in the drawings), for example, of a frequency of 105 MHz is set at a desired power to introduce the VHF power into the discharge space 6130 through the matching box 6116, thereby generating glow discharge. Thus, within the discharge space surrounded by the substrates 6112, the introduced raw material gas is excited and decomposed by the discharge energy, whereby a predetermined deposited film is formed on the conductive substrates 6112. In this operation, simultaneously with the introduction of the VHF power, the output of the substrate heater 6113 is adjusted to vary the substrate temperature at a predetermined value. For achieving uniform film formation, the substrate is rotated at a desired rotation speed by a substrate rotating motor (M) 6120. After the film formation of a desired thickness, the VHF power supply is stopped, and the flow-out valves are closed to stop the gas introduction into the reaction chamber, whereby the formation of a deposited film is completed. By repeating such operation plural times in a similar manner, there can be obtained the electrophotographic photosensitive member of a desired multi-layered structure.

In the formation of each layer, all the flow-out valves are naturally closed except valves for necessary gasses. Also, in order to prevent each gas from remaining in the reaction chamber 6111 or in the pipes from the flow-out valves 5251 to 5256 to the reaction chamber 6111, there is executed, if necessary, an operation of closing the flow-out valves 5251 to 5256, opening the auxiliary valve 5260, fully opening the main valve (not shown in the drawings) and exhausting the interior of the system to a high vacuum. The gas species and the valves operation mentioned above are naturally modified according to the forming conditions of each layer.

For heating the conductive substrate 5112 or 6112, there can be employed any heat generating member used in vacuum, for example, a heat-generating resistor such as a sheath heater, a coiled heater, a plate-shaped heater or a ceramic heater, a heat-radiating lamp such as a halogen lamp or an infrared lamp, or a heat generating member by heat exchange utilizing liquid, gas or the like. The surface material of the heating means may be composed of a metal such as stainless steel, nickel, aluminum or copper, ceramics of heat-resistant polymers. Otherwise, it is also possible to provide a heating chamber outside the reaction chamber 5111 or 6111 and to transport the conductive substrate 5112 or 6112 from the heating chamber to the reaction chamber 5111 or 6111 after heating the substrate therein.

In the VHF-PCVD process, the pressure of the discharge space is preferably within a range of 0.133 Pa to 66.5 Pa, more preferably 0.1333 Pa to 40 Pa and most preferably 0.133 Pa to 13.3 Pa.

The electrode 6115 provided in the discharge space in the VHF-PCVD process may have any size and shape as long as it does not disturb the discharge, but in practice it is preferably shaped as a cylinder of a diameter within a range of 1 mm to 10 cm. In such case, the electrode 6115 may have an arbitrary length as long as a uniform electric field can be applied to the conductive substrate 6112.

The electrode 6115 may be composed of any material having a conductive surface, for example, a metal such as stainless steel, Al, Cr, Mo, Au, In, Nb, Te, V, Ti, Pt, Pb or Fe, or alloys thereof, or a glass or ceramic material of which surface is made conductive.

The electrophotographic photosensitive member produced according to the method of the present invention is applicable not only to the electrophotographic copying apparatus but also to other electrophotographic applications such as a laser beam printer, a CRT printer, an LED printer, a liquid crystal printer, a laser engraving apparatus, etc.

In the following, the present invention will be described in more details by examples thereof, but the present invention is not limited to such examples.

EXAMPLE 1

The plasma CVD apparatus shown in FIG. 6 was employed to deposit a lower inhibition layer and a photoconductive layer in succession on a cylindrical Al substrate under the conditions shown in Table 1. Then the surface of the layer was etched under the conditions shown in Table 2 to modify the surface roughness. Subsequently a surface layer was deposited under the conditions shown in Table 3 to complete an electrophotographic photosensitive member.

In the present example, seven photosensitive members (Sample Nos. 1 to 7) were produced by varying the etching conditions.

The contents (atomic %) of N, O, F and B atoms in the produced electrophotographic photosensitive member were determined by SIMS analysis to be respectively, 0.5%, 0.8%, 0.12% and 2.5% in the surface layer and 0.005%, 0.007%, 0.0035% and 0.0012% in the photoconductive layer adjacent to the surface layer. The surface roughness of the obtained electrophotographic photosensitive member was measured by AFM (atomic force microscope).

The electrophotographic photosensitive member thus produced was evaluated in the following manner.

Adhesion test: The surface of the produced electrophotographic photosensitive member was scratched with a sharp needle in a cross-hatching pattern. The photosensitive member was immersed in water for a week, and the peeling of film from the scratch was visually inspected.

The symbols a, b and c in the item of the adhesion test means as follow.

a: Very satisfactory result was obtained without film peeling.

b: Peeling was very locally spread from the scratch.

c: Peeling was generated in a wide range in some cases.

Forced jam test: The photosensitive member was mounted on an electrophotographic apparatus, and a sheet jamming was forcedly generated during the sheet transportation. This operation was repeated 10 times, and the peeling of the photosensitive member was inspected on the formed image.

The symbols a, b and c in the item of the forced jam test means as follows.

a: Very satisfactory result was obtained without scar.

b: Photosensitive member was scarred slightly, but image was not scarred, without a practical problem.

c: Scar appearing on the formed image was formed on the photosensitive member.

Charging ability: The electrophotographic photosensitive member was mounted on an electrophotographic apparatus and subjected to corona discharge which was generated by applying a high voltage of +6 kV to the charger, and then the dark surface potential of the photosensitive member was measured at the developing position, by a surface potential meter.

Sensitivity: The electrophotographic photosensitive member was charged to a predetermined dark surface potential, then immediately irradiated with the light of a halogen lamp in which a wavelength range of 550 nm and more was eliminated with a filter, and the amount of light was regulated so that the light surface potential of the electrophotographic photosensitive member had a predetermined value. The light amount required in this state was obtained by calculation from the lighting voltage of the halogen lamp, and the sensitivity was evaluated by this light amount.

Residual potential: The electrophotographic photosensitive member was charged to a predetermined dark surface potential, and was immediately irradiated with relatively strong light (for example, 2 L·s) at a constant light amount from a halogen lamp as a light source. In the light of the light source, a wavelength of 550 nm and more was eliminated with a filter. After the irradiation, the light surface potential of the electrophotographic photosensitive member was measured with a surface potential meter.

Ghost: A Canon ghost test chart (Part No.: FY9-9040), on which a black spot having a reflective density of 1.1 and a diameter of 5 mm was adhered, was placed at an image front end portion of the original table, and a Canon halftone chart (Part No.: FY9-9042) was superposed thereon. In the copy image obtained in this state, the ghost was evaluated by measuring the difference between the reflective density of a ghost chart of 5 mmϕ on the halftone copy image and the reflective density of the halftone portion.

The charging ability, sensitivity, retentive potential and ghost were ranked in the following manner:

a: Excellent b: Good c: No problem in practical use d: In some cases, there is a problem in practical use.

The results of evaluation are shown in Table 4. Example 1 indicates that the present invention was particularly effective when the surface roughness was controlled within a range of 500 Å to 2000 Å and each of N, O, F and B is contained within a range of 0.001% to 5%.

EXAMPLE 2

The plasma CVD apparatus shown in FIG. 6 was used to deposit a low inhibition layer and a photosensitive layer in succession on a cylindrical Al substrate under the conditions shown in Table 1. Then the surface was etched under the conditions shown in Table 2 to control the surface roughness to about 800 Å. Then, a surface layer was deposited under the conditions shown in Table 5 to obtain the electrophotographic photosensitive member. In the present example, 8 electrophotographic photosensitive members (Sample Nos. 1 to 8) were produced by varying the contents of N, O, F and B in the surface layer. The N, O, F and B contents (atomic %) in the surface layer of the produced electrophotographic photosensitive member were measured by SIMS analysis. The contents of N, O, F and B in the photoconductive layer adjacent to the surface layer were respectively 0.005%, 0.007%, 0.0035% and 0.0001%.

The electrophotographic photosensitive member thus produced was evaluated in a similar manner as in Example 1.

The results of evaluation of Example 2 are shown in Table 6. The results of Example 2 indicate that the present invention was particularly effective when the surface roughness was controlled within a range of 500 Å to 2000 Å and each of N, O, F and B is contained within a range of 0.001% to 5%.

Comparative Example 1

The plasma CVD apparatus shown in FIG. 6 was used to deposit a lower inhibition layer and a photoconductive layer in succession on a cylindrical Al substrate under the conditions shown in Table 1. Then the surface of the layer was etched under the conditions shown in Table 2 to control the surface roughness. Then a surface layer was deposited under the conditions shown in Table 7 to complete the electrophotographic photosensitive member.

SIMS analysis revealed that the N, O, F and B contents in the surface layer of the produced electrophotographic photosensitive member were not much different from those in the photoconductive layer adjacent to the surface layer. The surface roughness Rz of the obtained electrophotographic photosensitive member was measured by an AFM (atomic force microscope) and was about 1500 Å.

The electrophotographic photosensitive member thus produced was evacuated in a similar manner as in Example 1. The results of evaluation of Comparative Example 1 are shown in Table 8. The results of Comparative Example 1 indicate that the effects of the present invention could not exhibit when the N, O, F and B contents in the surface layer are not higher than those in the adjacent layer, even in the case of controlling the surface coarseness within a range of 500 Å to 2000 Å.

EXAMPLE 3

The plasma CVD apparatus shown in FIG. 6 was used to deposit a lower inhibition layer and a photoconductive layer in succession on a cylindrical Al substrate under the conditions shown in Table 1, and an a-SiC buffer layer was deposited under the conditions shown in Table 9.

Then the surface of the layer was etched under the conditions shown in Table 2 to control the surface roughness. Thereafter, a surface layer was deposited under the conditions shown in Table 3 to complete the electrophotographic photosensitive member.

In thus produced electrophotographic photosensitive member, the N, O, f and B contents (atomic %) were measured by SIMS to be respectively 0.5%, 0.8%, 0.12% and 2.5% in the surface layer, and respectively 0.0045%, 0.0085%, 0.0025% and 0.0003% in the a-SiC buffer layer adjacent to the surface layer, and respectively 0.0025%, 0.0045%, 0.0015% and 0.0001% in the photoconductive layer adjacent to the a-SiC buffer layer. The surface roughness Rz of the produced electrophotographic photosensitive member was measured by an AFM (atomic force microscope) to be about 1000 Å.

Table 10 shows the results evaluated in a similar manner as in Example 1 on thus produced electrophotographic photosensitive member. The results of Example 3 indicate that the effects of the present invention were similarly obtained even when a buffer layer composed of a-SiC was provided between the photoconductive layer and the surface layer.

EXAMPLE 4

The plasma CVD apparatus shown in FIG. 6 was used to deposit a lower inhibition layer and a photoconductive layer on a cylindrical Al substrate under the conditions shown in Table 1 and in succession an a-SiC buffer layer under the conditions shown in Table 9 to obtain the electrophotographic photosensitive member. In the present example, the surface layer was deposited under the conditions shown in Table 3 without any control of the surface roughness to complete the photosensitive member.

In thus produced electrophotographic photosensitive member, the N, O, F and B contents (atomic %) were measured by SIMS to be respectively 0.5%, 0.8%, 0.12% and 2.5% in the surface layer, and respectively 0.0045%, 0.0085%, 0.0025% and 0.0003% in the a-SiC buffer layer adjacent to the surface layer, and respectively 0.0025%, 0.0045%, 0.0015% and 0.0001% in the photoconductive layer adjacent to the a-SiC buffer layer. The surface roughness Rz of the produced electrophotographic photosensitive member was measured by an AFM (atomic force microscope) to be about 2000 Å.

Evaluation of thus produced electrophotographic photosensitive member in a similar manner as in Example 1 provided very satisfactory results similar to Example 3. These results indicate that the effects of the present invention were obtained without any control of the surface roughness, for example, by etching, as long as the surface roughness was within the range of the present invention.

EXAMPLE 5

The plasma CVD apparatus shown in FIG. 6 was used to deposit a lower inhibition layer and a photoconductive layer on a cylindrical Al substrate under the conditions shown in Table 1 and in succession an a-SiC buffer layer under the conditions shown in Table 11 to obtain the electrophotographic photosensitive member.

The a-SiC buffer layer of the present example was formed so that the composition thereof smoothly changes from the photoconductive layer to the surface layer. Then a surface layer was deposited under the conditions shown in Table 11 without any control of the surface roughness to complete the photosensitive member.

In thus produced electrophotographic photosensitive member, the N, O, F and B contents (atomic %) were measured by SIMS to be respectively 0.5%, 0.8%, 0.12% and 2.5% in the surface layer, and respectively 0.0040%, 0.008%, 0.0030% and 0.0002% at the center in the thickness of the a-SiC buffer layer adjacent to the surface layer, and respectively 0.0015%, 0.0040%, 0.0010% and 0.0001% in the photoconductive layer adjacent to the a-SiC buffer layer. The surface roughness Rz of the produced electrophotographic photosensitive member was measured by an AFM (atomic force microscope), to be about 1800 Å.

Evaluation of thus produced electrophotographic photosensitive member in a similar manner as in Example 1 provided very satisfactory results similar to Example 3. These results indicate that the effects of the present invention were obtained, even when the composition of the buffer layer varied in the thickness direction thereof.

EXAMPLE 6

Figure 7:
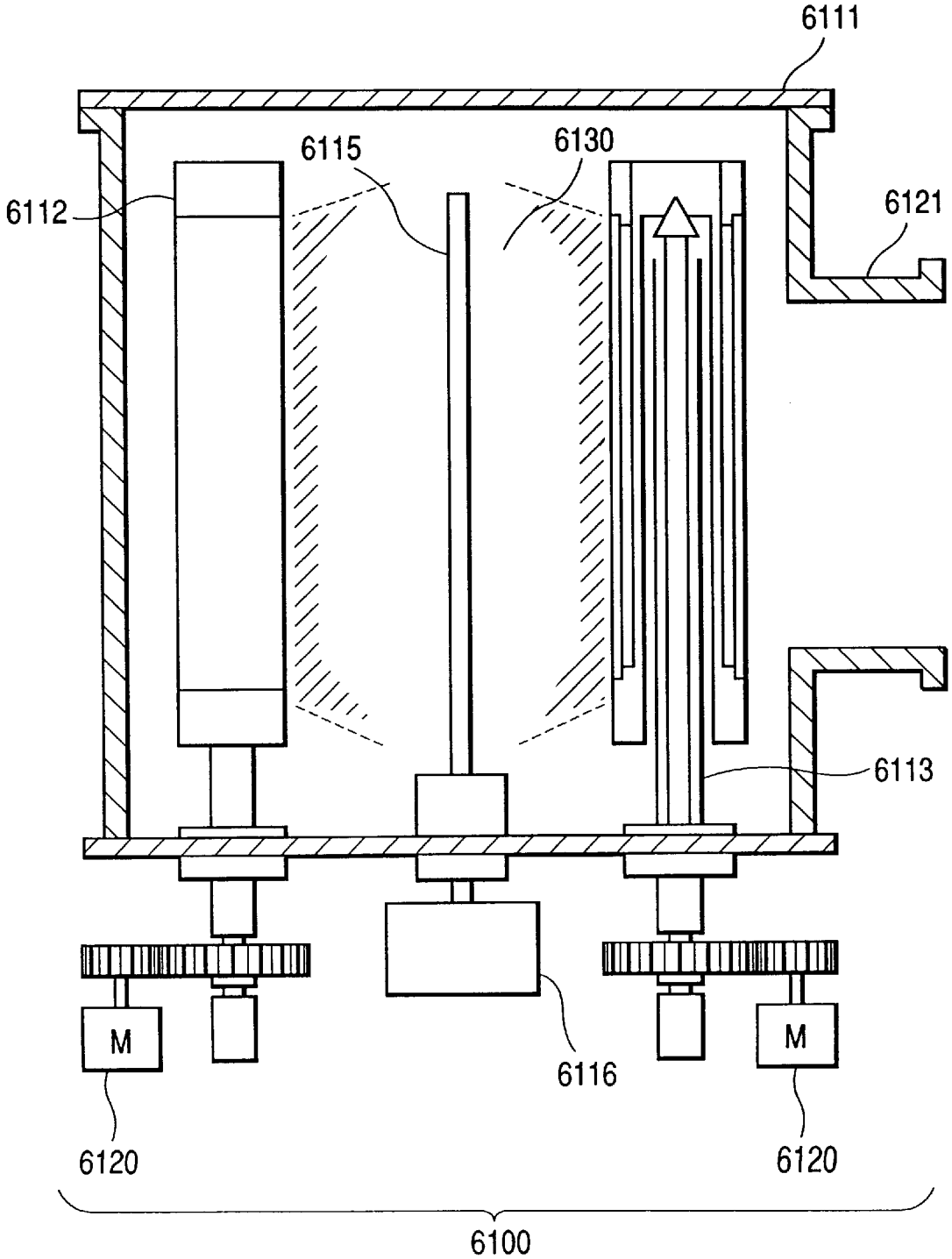

A mass-production apparatus shown in FIG. 7 utilizing the VHF plasma CVD process, instead of the plasma CVD apparatus shown in FIG. 6, was used to deposit a lower inhibition layer, a photoconductive layer, an a-SiC buffer layer and a surface layer on a cylindrical Al substrate under the conditions shown in Table 12 to produce the electrophotographic photosensitive member. The photosensitive member was completed without any control of the surface roughness of the surface layer. In thus produced electrophotographic photosensitive member, the N, O, F and B contents (atomic %) were measured by SIMS to be respectively 0.5%, 0.8%, 0.12% and 2.5% in the surface layer, and respectively 0.0035%, 0.075%, 0.0015% and 0.0004% in the a-SiC buffer layer adjacent to the surface layer, and respectively 0.0025%, 0.0045%, 0.0010% and 0.0002% in the photoconductive layer adjacent to the a-SiC buffer layer. The surface roughness Rz of the produced electrophotographic photosensitive member was measured by an AFM (atomic force microscope) to be about 1800 Å.

Evaluation of thus produced electrophotographic photosensitive member in a similar manner as in Example 1 provided very satisfactory results similar to Example 4. These results indicate that the effects of the present invention were obtained regardless of the film forming method.

According to the present invention, in an electrophotographic photosensitive member comprising, on a conductive substrate, a photoconductive layer composed of a non-single-crystalline material containing silicon atoms as a matrix, and a surface layer composed of non-single-crystalline carbon containing at least hydrogen, the surface layer has a surface roughness Rz within a range of 500 Å to 2000 Å for a reference length of 5 $\mu$m, and simultaneously contains at least all of oxygen, nitrogen, fluorine and boron atoms, and each of contents thereof is larger than each of those in a layer adjacent to the surface layer, whereby the present invention provides an electrophotographic photosensitive member with excellent electrical characteristics and high image quality and without any peeling, damage or abrasion in a long use term.

TABLE 1

| | | |
|---|---|---|
| Lower Inhibition layer | $SiH_4$ | 200 sccm |
| | $H_2$ | 500 sccm |
| | NO | 5 sccm |
| | $B_2H_6$ | 2000 ppm |
| | Power | 150 W |
| | Internal pressure | 80 Pa |
| | Substrate temperature | 200° C. |
| | Film thickness | 1.5 μm |
| Photo-conductive layer | $SiH_4$ | 510 sccm |
| | $H_2$ | 450 sccm |
| | Power | 450 W |
| | Internal pressure | 73 Pa |
| | Substrate temperature | 200° C. |
| | Film thickness | 20 μm |

TABLE 2

| | |
|---|---|
| $CF_4$ | 400 sccm |
| Power | 50 W to 2000 W |
| Substrate temperature | 200° C. |
| Pressure | 50 Pa |

TABLE 3

| | | |
|---|---|---|
| Surface layer | $CH_4$ | 200 sccm |
| | NO | 1 sccm |
| | $B_2H_6$ | 2000 ppm |
| | $CF_4$ | 5 sccm |
| | Power | 1000 W |
| | Internal pressure | 67 Pa |
| | Substrate temperature | 200° C. |
| | Film thickness | 0.3 μm |

TABLE 4

| Sample No. | No. 1 | No. 2 | No. 3 | No. 4 | No. 5 | No. 6 | No. 7 |
|---|---|---|---|---|---|---|---|
| Surface roughness ($R_z$) | 200Å | 400Å | 500Å | 1000Å | 1500Å | 2000Å | 2500Å |
| Adhesion | b | b | a | a | a | a | a |
| Forced jam | b | b | a | a | a | a | a |
| Charging ability | a | a | a | a | a | a | c |
| Sensitivity | a | a | a | a | a | a | c |
| Residual potential | a | a | a | a | a | a | c |
| Ghost | a | a | a | a | a | a | c |

TABLE 5

| | | |
|---|---|---|
| Surface layer | $CH_4$ | 500 sccm |
| | NO | (variable) |
| | $B_2H_6$ | (variable) |
| | $CF_4$ | (variable) |
| | Power | 1000 W |
| | Internal pressure | 67 Pa |
| | Substrate temperature | 200° C. |
| | Film thickness | 0.3 μm |

TABLE 6

| Sample No. | No.1 | No.2 | No.3 | No.4 | No.5 | No.6 | No 7 | No 8 |
|---|---|---|---|---|---|---|---|---|
| N content (%) | 0.0005 | 0.0005 | 1.0 | 3.2 | 1.5 | 0.001 | 1.5 | 4.5 |
| O content (%) | 0.0005 | 2.2 | 0.0005 | 2.5 | 1.2 | 0.001 | 1.0 | 4.4 |
| F content (%) | 0.0005 | 3.5 | 1.5 | 0.0005 | 2.3 | 0.001 | 3.0 | 4.5 |
| B content (%) | 0.0005 | 0.2 | 0.4 | 0.1 | 0.0005 | 0.001 | 0.5 | 4.6 |
| Adhesion | b | b | b | b | b | a | a | a |
| Forced jam | b | b | b | b | b | a | a | a |
| Charging ability | c | c | c | c | c | a | a | a |
| Sensitivity | c | c | c | c | c | a | a | a |
| Residual potential | c | c | c | c | c | a | a | a |
| Ghost | c | c | c | c | c | a | a | a |

TABLE 7

| | | |
|---|---|---|
| Surface layer | $CH_4$ | 200 sccm |
| | Power | 1000 W |
| | Internal pressure | 67 Pa |
| | Substracte temperature | 200° C. |
| | Film thickness | 0.3 μm |

TABLE 8

| | |
|---|---|
| Adhesion | b |
| Forced jam | b |
| Charging ability | c |
| Sensitivity | c |
| Residual potential | c |
| Ghost | c |

TABLE 9

| | | |
|---|---|---|
| a-SiC buffer layer | $SiH_4$ | 50 sccm |
| | $CH_4$ | 450 sccm |
| | Power | 450 W |
| | Internal pressure | 40 Pa |
| | Substracte temperature | 200° C. |
| | Film thickness | 0.5 μm |

TABLE 10

| Buffer layer | a-SiC |
|---|---|
| Adhesion | a |
| Forced jam | a |
| Charging ability | a |
| Sensitivity | a |
| Residual potential | a |
| Ghost | a |

TABLE 11

| | | |
|---|---|---|
| a-SiC buffer layer | $SiH_4$ | 10 sccm |
| | $CH_4$ | 50→450 sccm |
| | Power | 450 W |
| | Internal pressure | 50 Pa |
| | Substracte temperature | 200° C. |
| | Film thickness | 0.5 μm |
| Surface layer | $CH_4$ | 200 sccm |
| | NO | 1 sccm |
| | $B_2H_6$ | 2000 ppm |
| | $CF_4$ | 5 sccm |
| | Power | 1000 W |
| | Internal pressure | 67 Pa |
| | Substrate temperature | 200° C. |
| | Film thickness | 0.3 μm |

TABLE 12

| | | |
|---|---|---|
| Lower inhibition layer | $SiH_4$ | 150 sccm |
| | $H_2$ | 350 sccm |
| | NO | 3 sccm |
| | $B_2H_6$ | 2000 ppm |
| | Power | 200 W |
| | Internal pressure | 7 Pa |
| | Substrate temperature | 200° C. |
| | Film thickness | 1.5 μm |
| Photoconductive layer | $SiH_4$ | 200 sccm |
| | $H_2$ | 350 sccm |
| | Power | 450 W |
| | Internal pressure | 5 Pa |
| | Substrate temperature | 200° C. |
| | Film thickness | 20 μm |
| a-SiC buffer layer | $SiH_4$ | 10 sccm |
| | $CH_4$ | 400 sccm |
| | Power | 450 W |
| | Internal pressure | 5 Pa |
| | Substrate temperature | 200° C. |
| | Film thickness | 0.5 μm |
| Surface layer | $CH_4$ | 200 sccm |
| | NO | 1 sccm |
| | $B_2H_6$ | 3000 ppm |
| | $CF_4$ | 5 sccm |
| | Power | 1000 W |
| | Internal pressure | 7 Pa |

TABLE 12-continued

| | | |
|---|---|---|
| | substrate temperature | 200° C. |
| | Film thickness | 0.2 μm |

What is claimed is:

1. An electrophotographic photosensitive member comprising:

on a conductive substrate, a photoconductive layer composed of a non-single-crystalline material containing silicon atoms as a matrix, and a surface layer composed of non-single-crystalline carbon containing at least hydrogen, wherein the surface layer has a surface roughness Rz within a range from 500 Å to 2000 Å for a reference length of 5 μm and the surface layer further contains at least oxygen, nitrogen, fluorine and boron atoms, wherein each of said oxygen, nitrogen, fluorine and boron is present in amounts from 0.001 to 5 atomic %.

2. An electrophotographic photosensitive member according to claim 1, wherein the contents of oxygen, nitrogen, fluorine and boron atoms in the surface layer are larger than those in a layer adjacent to the surface layer.

3. An electrophotographic photosensitive member according to claim 1, further comprising a buffer layer between the photoconductive layer and the surface layer.

4. An electrophotographic photosensitive member according to claim 3, wherein the buffer layer is composed of a non-single-crystalline material containing silicon atoms as a matrix and further carbon atoms.

5. An electrophotographic photosensitive member according to claim 3, wherein the buffer layer simultaneously contains all of oxygen, nitrogen, fluorine and boron atoms, and contents of the oxygen, nitrogen, fluorine and boron atoms in the buffer layer are larger than those in the photoconductive layer adjacent to the buffer layer.

* * * * *